US005489131A

United States Patent [19]

Blom

[11] Patent Number: 5,489,131

[45] Date of Patent: Feb. 6, 1996

[54] LOCKING HANDLE FOR WINDOW

[75] Inventor: Marcia K. Blom, Albert Lea, Minn.

[73] Assignee: Truth Hardware Corporation, Owatonna, Minn.

[21] Appl. No.: 193,735

[22] Filed: Feb. 9, 1994

[51] Int. Cl.[6] ..... E05C 3/04

[52] U.S. Cl. ..... 292/101; 292/241; 292/DIG. 20

[58] Field of Search ..... 292/100–102, 292/240, 241, DIG. 47, DIG. 20, DIG. 30, DIG. 31, DIG. 63

[56] References Cited

U.S. PATENT DOCUMENTS

| | | | |
|---|---|---|---|
| 2,613,525 | 10/1952 | Holmsted | 292/101 |
| 2,716,262 | 8/1955 | Oswald | 292/DIG. 20 |
| 2,750,217 | 6/1956 | Landholt | 292/DIG. 31 |
| 2,755,119 | 7/1956 | Abel | 292/DIG. 20 |
| 4,674,777 | 6/1987 | Guelck | 292/101 |
| 5,248,174 | 9/1993 | Matz | 292/DIG. 47 |

OTHER PUBLICATIONS

"Truth" brand Catalog excerpts—pp. 14–14e (1988) and pp. 2.6–2.6g (1993).

Truth Hardware Brochure "24 Locking handle" (1988) pp. 14–14e.

Truth Hardware Brochure "24 Locking Handle" (1983) pp. 2.6–2.6g.

*Primary Examiner*—Steven N. Meyers

*Assistant Examiner*—Gary Estremsky

*Attorney, Agent, or Firm*—Wood, Phillips, VanSanten, Clark & Mortimer

[57] ABSTRACT

A lock for grasping a keeper to lock a window sash and window frame together including a base housing with a longitudinal opening therethrough and defines a pivot axis positioned between the ends of the opening, and a locking handle secured to the housing for pivoting about the pivot axis and including a handle portion extending from the one side of the housing opening and a grasping portion extending from the other side of the housing opening. The housing has a first shoulder facing one side of the housing opening and extending about the opening associated with one end and a second shoulder facing the other side of the opening and extending about the opening associated with the other end. A first handle shoulder abuts against the first housing shoulder when the locking handle is in a locking position, and a second handle shoulder is disposed adjacent to and overlapping with the second housing shoulder when the locking handle is in a locking position. Preferably, the housing defines a substantially smooth visible surface facing the one opening side, with the first housing shoulder recessed relative to the housing visible surface; and the locking handle includes a substantially smooth visible surface substantially surrounding the handle portion and facing the one opening side when the locking handle is in a locking position so that the visible surfaces cooperatively define a substantially smooth visible surface surrounding the handle portion when the locking handle is in a locking position.

13 Claims, 2 Drawing Sheets

Fig. 1
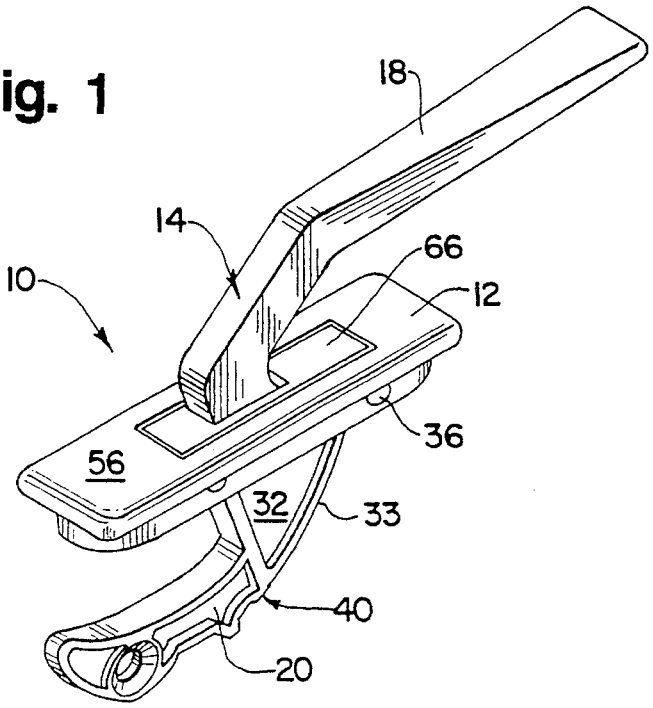
Fig. 2
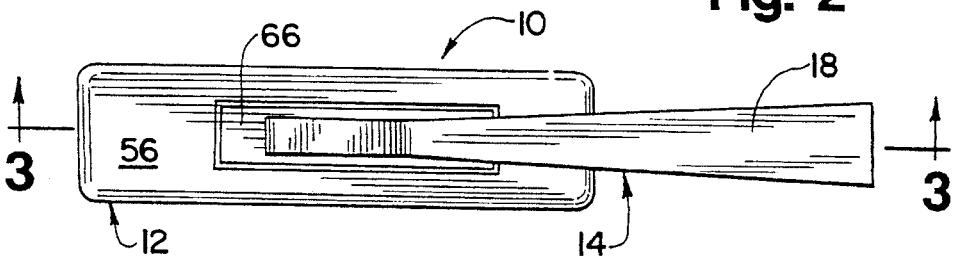
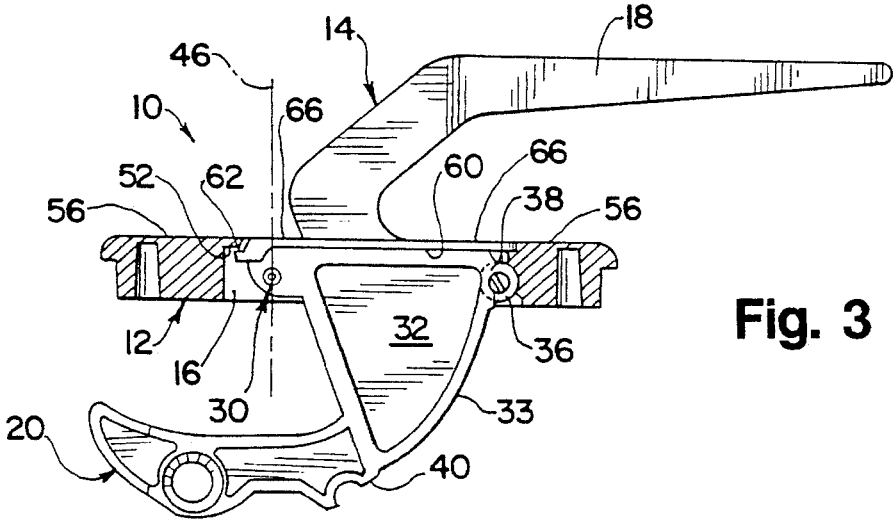
Fig. 3

LOCKING HANDLE FOR WINDOW

BACKGROUND OF THE INVENTION

1. Technical Field

The present invention is directed toward window locks, and more particularly toward a sealing window lock including a pivoting handle for securing a window sash to a window frame.

2. Background Art

Window locks are, of course, well known. One common window lock type uses a handle pivotally mounted to a housing which is itself mounted to the window frame, and a keeper is mounted to the movable window sash. The handle may be manually pivoted to move a grasping member into and out of engagement with the keeper to lock or release the window sash as desired.

Handle locks of the type mentioned above typically include an opening in the housing through which the grasping member portion of the handle extends. There is therefore a risk of an undesirable energy loss if a draft develops through the housing opening around the handle. Further, light might pass through the opening and around the handle which, even though if occurring when the window sash is open to otherwise let in air and light, nevertheless creates a visual impression that the lock and/or window are of low quality construction. Still further, there is also the possibility that insects might pass through the opening and into the room interior.

Several lock structures have been created to address this problem. One locking handle has included a shoulder associated with the handle and abutting the bottom portion of the housing (that is, the portion below the pivot axis) when closed. The top portion of the housing includes an arcuate pocket adjacent the handle portion above the pivot axis in order to substantially close the opening at that upper end. However, because the pivot axis is offset from the visible surface of the housing, the handle portion above the pivot axis is necessarily rounded to cooperate with the arcuate pocket. As a result, there is a recess beneath the plane of the visible housing surface at the rounded end which detracts from the visually clean lines of the structure. Further, while the rounded end and the arcuate pocket block any straight path for air, light and/or insects, some spacing is required in order to allow the handle to pivot without binding and that spacing could still result in some air draft therethrough. Still further, the arcuate pocket results in a configuration which requires that the pivot holes in the housing be created by drilling therethrough, a step which naturally adds to the time and therefore cost of manufacture Another locking handle structure which addresses the problems associated with space between a locking handle and housing is disclosed in Guelck U.S. Pat. No. 4,674,777. In this structure, the pivot for the handle is offset from the housing opening so that a shoulder may be freely carried with the handle and surround the housing opening to provide a seal when the handle is in a locking position. This structure can, however, leave a significant open space through the housing when the shoulder is not seated. Further, the feel of such a lock is somewhat unusual to a person operating it due to the unusual position of its pivot axis.

The present invention is directed toward overcoming one or more of the problems set forth above.

SUMMARY OF THE INVENTION

In one aspect of the present invention, a lock for grasping a keeper to lock a window sash and window frame together is disclosed including a base housing and a locking handle. The base housing includes a longitudinal opening therethrough and defines a pivot axis positioned between the ends of the opening. The housing has a first shoulder facing one side of the housing opening and extending about the opening associated with one end and a second shoulder facing the other side of the opening and extending about the opening associated with the other end. The locking handle is secured to the housing for pivoting about the pivot axis, and includes a handle portion extending from the one side of the housing opening and a grasping portion extending from the other side of the housing opening. The grasping portion is disposed to grasp an adjacent keeper when the locking handle is in a locking position. A first handle shoulder abuts against the first housing shoulder when the locking handle is in a locking position, and a second handle shoulder is disposed adjacent to and overlapping with the second housing shoulder when the locking handle is in a locking position.

In another aspect of the present invention, the first and second housing shoulders lie in substantially the same plane and the first and second handle shoulders lie in substantially the same plane. The housing defines a substantially smooth visible surface facing the one opening side, with the first housing shoulder recessed relative to the housing visible surface; and the locking handle includes a substantially smooth visible surface substantially surrounding the handle portion and facing the one opening side when the locking handle is in a locking position. The housing visible surface and the locking handle visible surface cooperatively define a substantially smooth visible surface substantially surrounding the handle portion when the locking handle is in a locking position.

It is an object of the invention to provide a reliable handle lock structure which may be easily and inexpensively manufactured.

It is another object of the invention to provide a handle lock structure compact and aesthetically pleasing in appearance.

It is still another object of the invention to provide a handle lock structure which minimizes the passing of energy, insects and/or light around the handle to not only ensure that the window not become a passageway for undesirable elements but also to provide an appearance and assurance of high quality construction,

BRIEF DESCRIPTION OF THE DRAWINGS

FIG. 1 is a perspective view of the lock of the present invention as in the locking position;

FIG. 2 is a plan view of the lock of FIG. 1;

FIG. 3 is a cross-sectional view of the lock as taken through line 3—3 of FIG. 2.

DESCRIPTION OF THE PREFERRED EMBODIMENT

Figure 4:
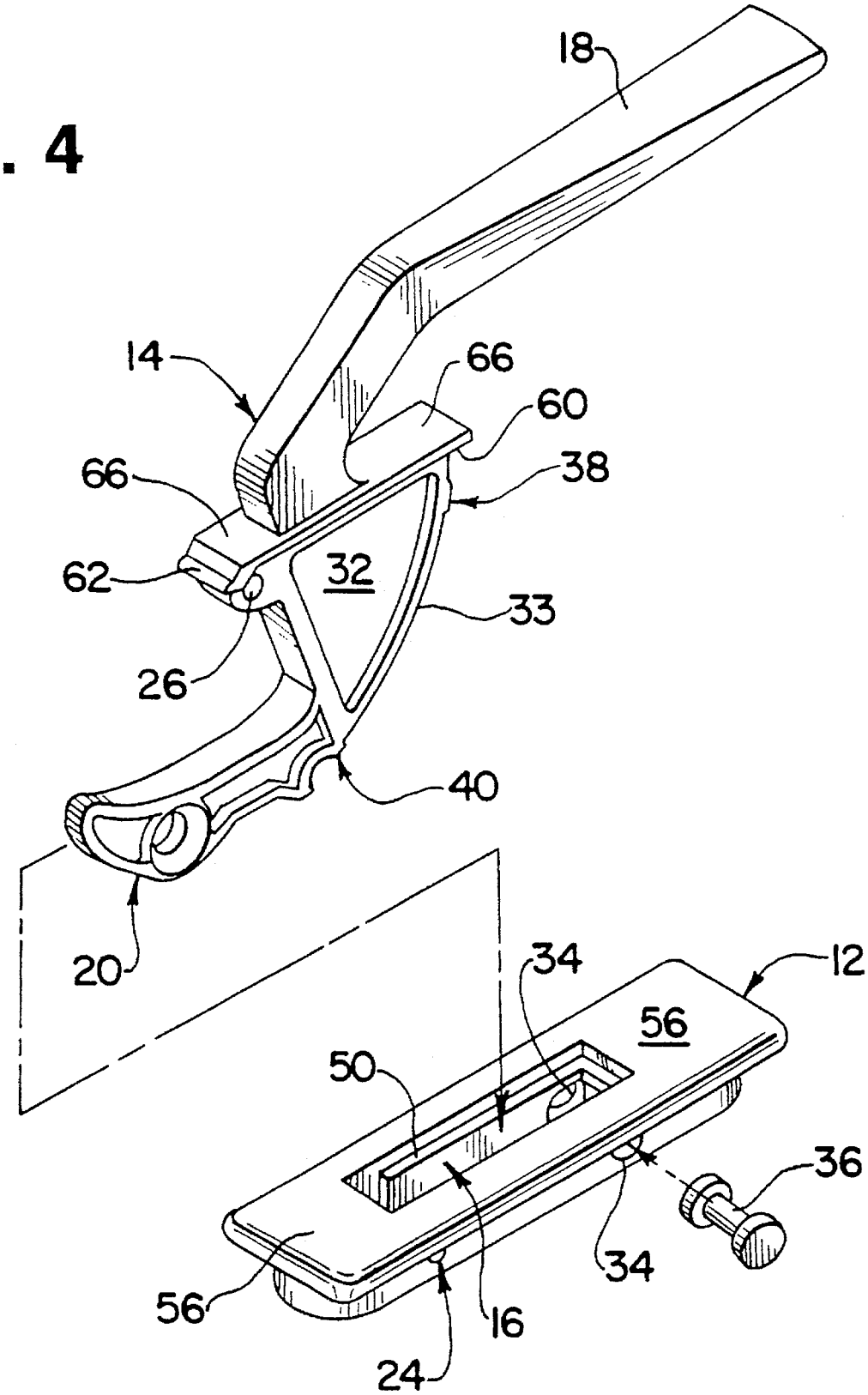
FIG. 4 is a exploded perspective view of the lock of FIG. 1.

A window lock structure 10 according to the present invention is shown in FIG. 1. The lock structure 10 includes a base housing 12 with a locking handle 14 extending through a longitudinal opening 16 in the housing 12, The handle 14 also includes a handle portion 18 and a grasping portion 20.

Typically, the housing 12 is suitably secured (for example, by screws) to the face of a window frame (not shown) with the handle portion 18 extending into the interior of the room so that a person inside the room can reach the handle portion to open and close the lock as desired and the grasping portion 20 projecting toward the window sash (also not shown) for grasping a keeper on the sash for locking. Still further, a common configuration is with the housing 12 secured in a vertical orientation with the handle portion 18 extending into the room and downwardly when in a locking position. Accordingly, while such a convention will be referred to herein at times, it should be understood that the orientation of the lock structure 10 relative to horizontal and vertical could be changed depending on the particular installation.

The housing 12 includes a pair of aligned holes 24 on opposite sides of the opening 16 and generally nearer one end of the opening 16 than the other. As will be understood by those skilled in the art, the simple design of the housing 12 allows these holes 24 to be formed by coring during molding. As a result, the cost of making the housing 12 is substantially reduced as compared with prior art housings in which the holes could not readily be cored and therefore instead had to be drilled.

The locking handle 14 includes a hole 26 which is aligned with the housing holes 24 and secured thereto by a suitable pivot construction 30, such as a simple rivet or the construction shown in U.S. Pat. No. 5,103,533 (the complete disclosure of which is hereby incorporated by reference).

The locking handle 14 also preferably includes a disk portion 32 with an annular surface 33 centered on the pivot 30. This disk portion serves to ensure that the locking handle 14 has the required strength without bending should forced entry be attempted, and further serves to partially block the opening 16 when the handle 14 is not in its locking position.

The housing 12 also preferably includes a pair of aligned holes 34 at the opposite end of the opening 16, within which a suitable cylindrical plastic member 36 is secured as is known in the prior art. The plastic member 36 cooperates with a pair of detents 38, 40 on the disk portion annular surface 33 of the locking handle 14 to provide a positive feel and to secure the locking handle 14 in either its locking or unlocked positions.

The closure of the opening 16 is accomplished by cooperation of various shoulders on the locking handle 14 and base 12. In the following discussion, reference will be made to horizontal and vertical according to the above mentioned typical installation in which the housing 12 is oriented vertically with the opening 16 passing horizontally therethrough, and the handle portion 18 extending toward the room interior and downwardly when in the locking position. Still further, in such an orientation, a horizontal plane through the pivot construction 30 (seen as a vertical plane 46 in FIG. 3 in which the lock 10 is oriented 90 degrees counterclockwise relative to the vertical orientation used in the below discussion) divides a top opening portion (to the left of plane 46 in FIG. 3) from a bottom opening portion (to the right of plane 46 in FIG. 3).

More specifically, the housing 12 includes a first shoulder 50 facing toward the interior and extending about the bottom opening portion (i.e., disposed beneath the plane 46). The housing 12 further includes a second shoulder 52 facing the exterior and extending at least across the top end of the opening 16. In a preferred embodiment of the present invention, the first shoulder 52 is recessed beneath the housing interior face an amount substantially equal to the thickness of the housing flange defining the second shoulder 52 so that the first and second housing shoulders 50, 52 lie in substantially the same plane.

The locking handle 14 includes a first shoulder 60 which overlies and abuts against the first housing shoulder 50 when the locking handle is in a locking position. The locking handle 14 further includes a second shoulder 62 which is disposed adjacent to and overlaps the second housing shoulder 52 when the locking handle 14 is in a locking position. In a preferred embodiment, the first and second handle shoulders 60, 62 also lie in substantially the same plane.

The second housing and handle shoulders 52, 62 in a preferred embodiment do not fully surround the top opening portion but instead extend only across the top end in order to simplify casting and avoid introducing any weakness into the housing 12 as might occur were the second housing shoulder 52 to extend around the sides of the opening 16 (as such a shoulder would require widening the opening 16 at that end in the area of the pivot holes 24). However, it should also be understood that it would be within the scope of the present invention to extend the second shoulders 52, 62 around to the sides of the opening 16 to substantially surround the top opening portion if casting and strength considerations did not require otherwise.

In a preferred embodiment of the present invention, the housing interior face 56 is substantially smooth, and the locking handle 14 includes a substantially smooth interior surface 66 about the handle portion 18 which is also visible from the interior when the locking handle 14 is in a locking position. As illustrated in FIGS. 1–3, the housing interior surface 56 and the locking handle interior surface 66 cooperatively define a substantially smooth interior facing surface substantially surrounding the handle portion 18 when the locking handle 14 is in a locking position. This configuration thus allows the lock structure 10 to be manufactured with very smooth lines to provide a compact and aesthetically pleasing appearance.

It should now be readily apparent that the present invention is a reliable handle lock structure which may be easily and inexpensively manufactured. This handle lock will also minimize the passing of energy, insects and/or light around the handle to not only ensure that the window not become a passageway for undesirable elements but also to provide an appearance and assurance of high quality construction.

Still other aspects, objects, and advantages of the present invention can be obtained from a study of the specification, the drawings, and the appended claims.

I claim:

1. In a locking handle for grasping a keeper to lock a window sash and window frame together including a base housing including a longitudinal opening therethrough and defining a pivot axis positioned between the ends of the opening, a locking handle secured to said housing for pivoting about said defined pivot axis, said handle including a handle portion extending from one side of the housing opening, a grasping portion extending from the other side of the housing opening, said grasping portion being disposed to grasp an adjacent keeper when said locking handle is in a locking position, the improvement comprising:

a first housing shoulder facing said one side of the housing opening and extending about substantially all of the opening associated with the one end;

a second housing shoulder facing the other side of the housing opening and extending about the opening associated with the other end;

a first handle shoulder on one side of the pivot axis, said first handle shoulder abutting against substantially all of said first housing sshoulder when said locking handle is in a locking position; and a second handle shoulder on the other side of the pivot axis, said second handle shoulder disposed adjacent to and overlapping said second housing shoulder when said locking handle is in a locking position.

2. The improvement of claim 1, wherein said pivot axis is disposed nearer said other opening end than the one opening end whereby the first housing shoulder is substantially longer than the second housing shoulder.

3. The improvement of claim 1, wherein:

said first and second housing shoulders lie in substantially the same plane;

said first and second handle shoulders lie in substantially the same plane;

said housing defines a substantially-smooth visible surface facing the one opening side, said first housing shoulder being recessed relative to said housing visible surface; and said locking handle includes a substantially smooth visible surface substantially surrounding the handle portion and facing the one opening side when said locking handle is in a locking position;

whereby said housing visible surface and said locking handle visible surface cooperatively define a substantially smooth visible surface substantially surrounding said handle portion when said locking handle is in a locking position.

4. A lock for grasping a keeper to lock a window sash and window frame together, comprising:

a base housing including a longitudinal opening therethrough and defining a pivot axis positioned between the ends of the opening, said housing having a first shoulder facing one side of the housing opening and extending about substantially all of the opening associated with one end and a second shoulder facing the other side of the opening and extending about the opening associated with the other end; and a locking handle secured to said housing for pivoting about said defined pivot axis, said handle including a handle portion extending from said one side of the housing opening, a grasping portion extending from said other side of the housing opening, said grasping portion being disposed to grasp an adjacent keeper when said locking handle is in a locking position, a first handle shoulder abutting against substantially all of said first housing shoulder when said locking handle is in a locking position; and a second handle shoulder disposed adjacent to and overlapping with said second housing shoulder when said locking handle is in a locking position.

5. The lock of claim 4, wherein said pivot axis is disposed nearer said other opening end than the one opening end whereby the first housing shoulder is substantially longer than the second housing shoulder.

6. The lock of claim 5, wherein said second housing shoulder extends at least across the other opening end.

7. The lock of claim 4, wherein said first and second housing shoulders lie in substantially the same plane.

8. The improvement of claim 7, wherein:

said first and second handle shoulders lie in substantially the same plane;

said housing defines a substantially smooth visible surface facing the one opening side, said first housing shoulder being recessed relative to said housing visible surface; and said locking handle includes a substantially smooth visible surface substantially surrounding the handle portion and facing the one opening side when said locking handle is in a locking position;

whereby said housing visible surface and said locking handle visible surface cooperatively define a substantially smooth visible surface substantially surrounding said handle portion when said locking handle is in a locking position.

9. A lock for grasping a keeper to lock a window sash and window frame together, said sash and frame cooperating to separate an interior and an exterior, comprising:

a base housing securable to a window frame in a generally vertical orientation and including a horizontal opening therethrough between the interior and exterior;

a pivot axis fixed relative to the housing and defined between the top and bottom ends of the housing opening;

a first housing shoulder facing the interior and extending about substantially all of the opening disposed beneath the pivot axis;

a second housing shoulder facing the exterior and extending about the opening disposed above the pivot axis; and a locking handle secured for pivoting about said pivot axis, said handle including a handle portion extending toward the interior, a grasping portion extending toward the exterior, said grasping portion being disposed to grasp an adjacent keeper when said locking handle is in a locking position with a sash adjacent the frame, a first handle shoulder abutting against substantially all of said first housing shoulder when said locking handle is in a locking position, and a second handle shoulder disposed adjacent and overlapping said second housing shoulder when said locking handle is in a locking position.

10. The lock of claim 9, wherein said pivot axis is disposed nearer said top opening end than the bottom opening end whereby the first housing shoulder is substantially longer than the second housing shoulder.

11. The lock of claim 10, wherein said second housing shoulder extends at least across the top opening end.

12. The lock of claim 9, wherein said first and second housing shoulders lie in substantially the same plane and said first and second handle shoulders lie in substantially the same plane.

13. The lock of claim 12, wherein:

said housing defines a substantially smooth interior surface facing the interior, said first housing shoulder being recessed relative to said interior surface; and said locking handle includes a substantially smooth interior surface about the handle portion and facing the interior when said locking handle is in a locking position;

whereby said housing interior surface and said locking handle interior surface cooperatively define a substantially smooth interior facing surface substantially surrounding said handle portion when said locking handle is in a locking position.

* * * * *